United States Patent [19]

Günter et al.

[11] Patent Number: 4,945,835

[45] Date of Patent: Aug. 7, 1990

[54] SHAPED CHARGE PROJECTILE

[75] Inventors: Michael Günter, Meerbusch; Siegfried Quick; Jürgen Funk, both of Düsseldorf, all of Fed. Rep. of Germany

[73] Assignee: Rheinmetall GmbH, Düsseldorf, Fed. Rep. of Germany

[21] Appl. No.: 373,683

[22] Filed: Jun. 28, 1989

[30] Foreign Application Priority Data

Jul. 14, 1988 [DE] Fed. Rep. of Germany ..... 3823908

[51] Int. Cl.[5] ..... F42B 12/10

[52] U.S. Cl. ..... 102/476

[58] Field of Search ..... 102/306–310, 102/476, 518

[56] References Cited

U.S. PATENT DOCUMENTS

| | | | |
|---|---|---|---|
| 2,419,414 | 4/1947 | Mohaupt | 102/476 |
| 2,603,155 | 7/1952 | Clarke et al. | 102/476 |
| 3,002,455 | 10/1961 | Jarnholt | 102/476 |
| 3,137,233 | 6/1964 | Lipinski | 102/476 |
| 3,188,955 | 6/1965 | Brown . | |
| 3,348,485 | 10/1967 | Dufour | 102/518 |
| 3,485,460 | 11/1969 | Mertens . | |
| 3,922,967 | 3/1975 | Mertens . | |
| 4,108,073 | 8/1978 | Davis | 102/518 |
| 4,114,537 | 9/1978 | Brown | 102/306 |
| 4,703,695 | 11/1987 | Langer | 102/476 |

FOREIGN PATENT DOCUMENTS

| | | |
|---|---|---|
| 866318 | 12/1952 | Fed. Rep. of Germany . |
| 1082163 | 5/1960 | Fed. Rep. of Germany . |
| 1051407 | 4/1966 | Fed. Rep. of Germany . |
| 2232955 | 1/1974 | Fed. Rep. of Germany . |
| 3441693 | 2/1986 | Fed. Rep. of Germany . |
| 1002092 | 3/1952 | France . |

*Primary Examiner*—Harold J. Tudor

*Attorney, Agent, or Firm*—Spencer & Frank

[57] ABSTRACT

A shaped charge projectile includes a projectile housing, explosives and a shaped charge liner in the projectile housing, and a front hood to cover the shaped charge liner. To reduce the impact shock when the projectile hits a target, the front portion of the hood is configured as a deformable region, with a wall thickness that decreases toward the center point of the hood. Furthermore, in order to reliably support the internal warhead and maintain a sufficient stand-off distance even with the hardest target impact, the hood has a cylindrical attachment portion with a wall thickness of about three times the wall thickness of the projectile housing.

18 Claims, 1 Drawing Sheet

SHAPED CHARGE PROJECTILE

BACKGROUND OF THE INVENTION

The present invention relates to a shaped charge projectile, and more particularly to a shaped charge projectile of the type which includes a cylindrical projectile housing which is forwardly open, an explosive charge, a detonator, and a shaped charge liner embedded in the projectile housing, and a front hood which closes the forwardly open projectile housing.

Such a shaped charge projectile is disclosed, for example, in U.S. Pat. No. 3,922,967. Here, the active portion of the projectile is composed of an explosive charge provided with a forward acting shaped charge liner. In the center of the cone of the shaped charge liner, within the hemispherical projectile hood, there is provided a pyrotechnic impact detonator which includes a backfiring charge to detonate the explosive charge. The drawback of this projectile configuration is the frontal arrangement of the detonator ahead of the shaped charge liner because the jet of the liner must absolutely have available, in order to properly form, a certain free space and stand-off from the target.

Thus, we consider it advisable to arrange the impact detonator behind the active portion of the projectile and to keep the space in front of the shaped charge liner free of any built-in components. Furthermore, our tests have shown that, with a simple hood design—particularly if the projectile impacts on hard targets such as, for example, armor plates or concrete walls—loosening and forward displacement of the explosive filler material and of the shaped charge liner may interfere with formation of the jet and reduce performance unless appropriate supporting measures for the internal warhead are provided by way of a projection or a stop.

U.S. Pat. No. 3,485,460 discloses a projectile hood for a flight projectile which comes in different embodiments where the front end has different degrees of curvature. For example, the front end may have a relatively small radius of curvature in the form of a hemisphere for long trajectories, or a relatively large radius of curvature in a spherical calotte shape (flat head with greater deceleration effect) for short trajectories. Measures to ensure reliable detonation stand-off are not provided here.

SUMMARY OF THE INVENTION

It is an object of the present invention to provide a front projectile hood for a projectile of this type in which the detonator is disposed at the rear, and which ensures an immovable seat for the internal warhead even if the projectile impacts on a hard target and which ensures the necessary free space and stand-off from the target surface for optimum jet formation from the shaped charge liner even if the hood is deformed.

In accordance with the present invention, this object is attained by providing a shaped charge projectile of the above-mentioned type which is characterized in that, in the region of its front curvature, the hood has a decreasing wall thickness from a rearwardly oriented, cylindrical attachment portion to the front center point of the hood, and in that the cylindrical attachment portion of the hood includes a rearwardly oriented outer annular member which has a larger diameter than the projectile housing, a rearwardly oriented inner annular member which has a smaller diameter than the projectile housing, and a forwardly oriented annular recess disposed therebetween in the connection region with the projectile housing as a common support for the explosive charge and the shaped charge liner.

The wall of the hood may be stepped. A stepped hood wall, i.e. a wall which becomes thicker from the front toward the back and is provided with weak points for an intentional partial deformation upon impact, ensures uninterfered-with jet formation with optimum effect on the target even with a flattened projectile head.

The attachment portion serves as a shoulder or abutment to provide a firm support for the warhead, including the explosive charge and the shaped charge liner, upon impact on a hard target, and to prevent disadvantageous displacement in the structurally simply configured projectile housing. Thus even if there is a hard impact on a target, for example on armor plate or on a concrete wall, the shaped charge projectile will not lose power due to displacement of the explosive charge and the shaped charge liner toward the front.

DESCRIPTION OF THE PREFERRED EMBODIMENTS

Figure 1:
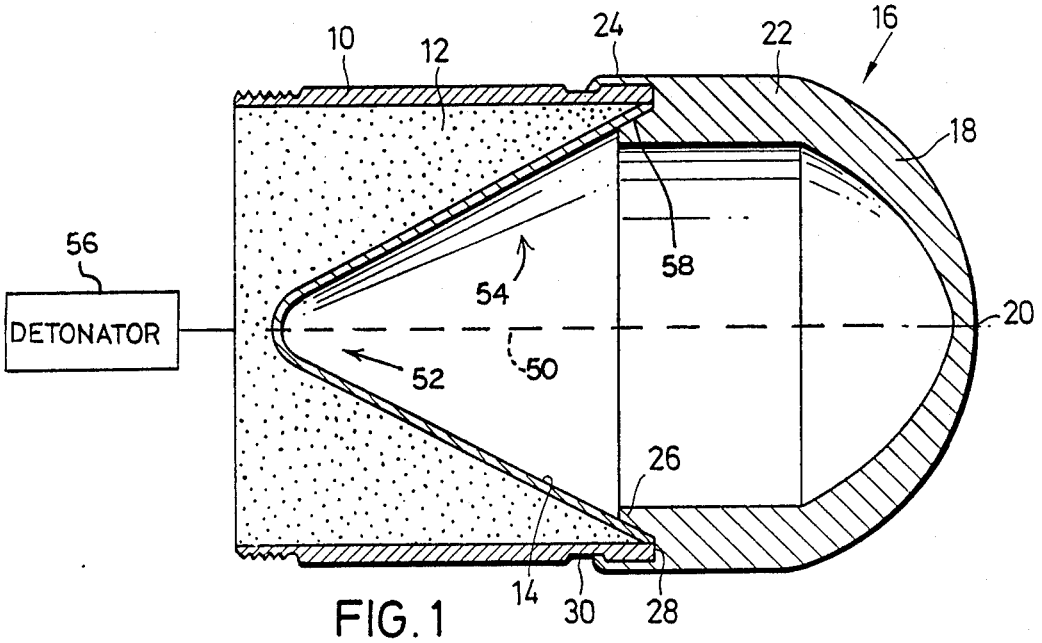
FIG. 1 is a cross-sectional view depicting a first embodiment according to the invention, and depicts a projectile hood disposed on a projectile housing, of which only the front is shown.

In FIG. 1, reference numeral 10 identifies the front portion of a thin-walled, cylindrical projectile housing serving as an example. Housing 10 has a longitudinal axis 50. Within projectile housing 10, an explosive charge 12 and a shaped charge liner 14 are disposed as the warhead. Shaped charge liner 14 has an apex region 52 that is disposed along axis 50 and a wall region 54 which is disposed at an angle with respect to axis 50. The shaped charge liner 14 may have any desired shape; for example, it may be configured as a pointed cone or a flat cone or in the form of a spherical calotte for a P-charge liner.

Shaped charge liner 14 terminates at the front flush with projectile housing 10. Projectile housing 10, which is provided with a rear projectile detonator 56 (shown only schematically) and is open toward the front, is closed off at the front by a hood 16 which is curved at its tip. In the curved portion 18 at its front, the wall thickness of hood 16 continuously decreases toward the front center point 20 of the hood, thus permitting a certain limited deformation upon impact on the target.

The front curved portion 18 is followed, toward projectile housing 10, by a cylindrical attachment portion 22. Cylindrical attachment portion 22 has a greater wall thickness than projectile housing 10 and is not deformed upon impact on the target. Preferably, the wall thickness of cylindrical attachment portion 22 is three times the wall thickness of projectile housing 10. Thus, cylindrical attachment portion 22 serves as a support and ensures a firm seat for the internal warhead, and also provides sufficient stand-off from the target for the shaped charge liner 14 so that a powerful penetrating jet is able to develop.

In the region of connection with projectile housing 10, hood 16 or, more precisely, cylindrical attachment portion 22, is provided with a rearwardly oriented outer annular member 24 which has a larger inner diameter than projectile housing 10. Attachment portion 22 also has a rearwardly oriented inner ring member 26, which has a smaller outer diameter than projectile housing 10, and an annular recess 28 disposed between members 24 and 26 as a joint support for explosive charge 12 and shaped charge liner 14. As is shown, the front end of housing 10 and the forward edge of liner 14 are received in recess 28, and the outer surface 58 of inner ring member 26 slopes with respect to axis 50.

Projectile housing 10 has a circumferential groove 30 in the front connection region to fix hood 16. The edges of the rearwardly oriented outer annular member 24 of hood 18 are flanged or rolled into groove 30.

In another embodiment, not shown, the diameter of the hood 16 is smaller than the diameter of the projectile housing 10, which extends slightly toward the front beyond the shaped charge liner 14. The hood is provided with a circumferential groove (corresponding to groove 30) in the region of connection. In this alternative embodiment the hood 16 is fastened to the projectile housing 10 by bending the projecting edge of the projectile housing into the groove in the hood.

Figure 2:
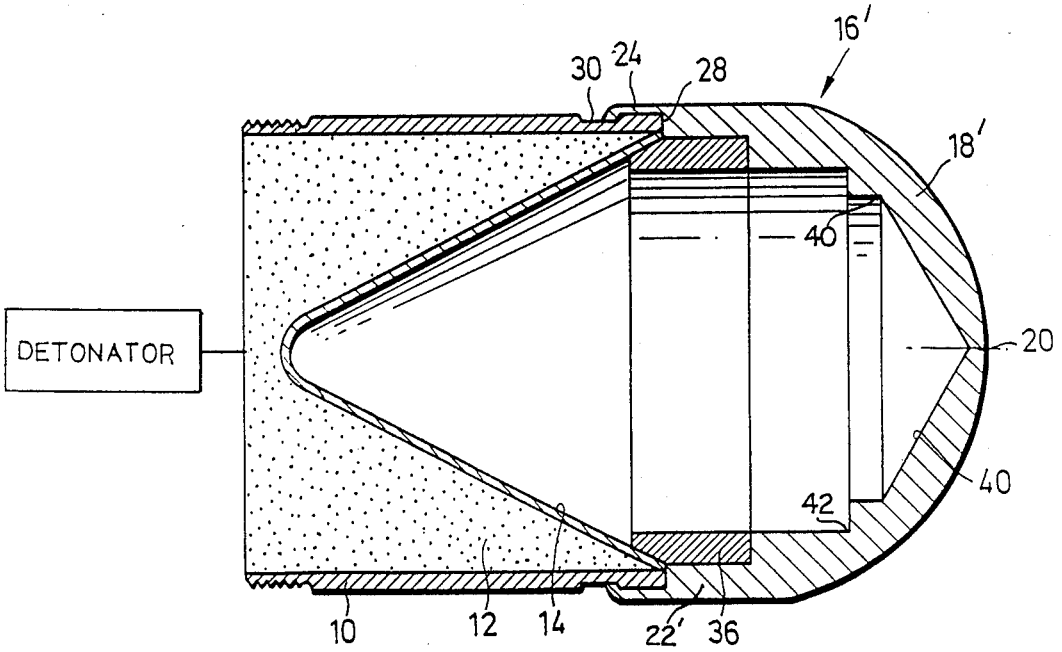
FIG. 2 is a cross-sectional view depicting a further embodiment according to the invention.

FIG. 2 shows another embodiment of a hood 16' in a form which is easier to manufacture than the embodiment of FIG. 1. Here the wall thickness of the front curved portion 18' decreases in steps from the rear toward the front.

For a hood blank of aluminum, preferably an aluminum alloy having a tensile strength of at least 28 $kp/mm^2$, the inner wall of cylindrical attachment portion 22' is turned in a first process step. In a second process step, the inner front hood wall is centrally hollowed out by turning at 40 to form a cone. This may be done using a cone cutter, for example, or a conically configured drill. The interior is also machined to provide several weak points 40 and 42 which increase in thickness from the front toward the rear so that a given deformation is ensured in the front curved portion 18' of the hood 16' if the projectile hits a hard target, and so that dissipation of the disadvantageous shock energy is ensured for the interior components of the projectile.

To improve the supporting effect of the inner annular portion of hood 16' for its internal warhead, an inserted annular insert member 36 is provided. It is preferably composed of an aluminum alloy having a tensile strength of at least 52 $kp/mm^2$.

The hoods 16 and 16' may also be made of plastic. In that case, the respective wall thickness must be adapted to the strength of the material. If the hood is made of plastic, the use of an annular insert 36, e.g. of aluminum or a solid material, is possible as well.

It will be understood that the above description of the present invention is susceptible to various modifications, changes, and adaptations, and the same are intended to be comprehended within the meaning and range of equivalents of the appended claims.

What we claim is:

1. A shaped charge projectile, comprising:

a cylindrical projectile housing having a front end with an opening;

a shaped charge liner in the projectile housing, the shaped charge liner having a forward edge that is oriented toward the front end of the housing;

an explosive charge in the projectile housing behind the shaped charge liner; and a hood to close the opening at the front end of the projectile housing, the hood having a front portion with a center point and having a cylindrical attachment portion which is joined to the projectile housing at a connection region, the front portion of the hood having a wall with a thickness that decreases from the attachment portion to the center point and having an outer surface that is curved, the attachment portion of the hood having, at the connection region, a rearwardly oriented outer annular member which has a large inner diameter than the projectile housing, a rearwardly oriented inner annular member which has a smaller outer diameter than the projectile housing, and an annular recess between the inner and outer members, the annular recess receiving the forward edge of the shaped charge liner and providing a support for the explosive charge and the shaped charge liner when the hood hits a target.

2. The shaped charge projectile of claim 1, further comprising a detonator in the projectile housing.

3. The shaped charge projectile of claim 1, wherein the projectile housing has a wall and wherein the attachment portion of the hood has a wall with a thickness of about three times the wall thickness of the projectile housing.

4. The shaped charge projectile of claim 1, wherein the hood comprises a shell element and an annular element inserted into the shell element, the annular element providing the inner annular member.

5. The shaped charge projectile of claim 4, wherein the shell element is composed of an aluminum alloy having a tensile strength of at least 28 $kp/mm^2$ and wherein the annular element is composed of an aluminum alloy having a tensile strength of at least 52 $kp/mm^2$.

6. The shaped charge projectile of claim 1, wherein the front portion of the hood has a wall thickness that changes in steps.

7. The shaped charge projectile of claim 6, wherein the front portion of the hood has an inner surface with a conical central region which is hollowed out by turning.

8. The shaped charge projectile of claim 1, wherein the projectile housing has an annular groove adjacent the opening at the front end, and wherein the outer annular member of the attachment portion is bent into the groove to join the attachment portion to the projectile housing.

9. The shaped charge projectile of claim 1, wherein the outer surface of the front portion of the hood is hemispherical, the front portion of the hood merging into the cylindrical attachment portion of the hood.

10. A shaped charge projectile, comprising:

a cylindrical projectile housing having a front end with an opening and having an axis which runs through the opening;

a generally conical shaped charge liner in the housing, the shaped charge liner having an apex region which is disposed along the axis of the housing and having a wall region which terminates in an edge that is concentric with respect to the opening at the front end of the housing, the wall region sloping at a constant angle with respect to the axis of the housing from the apex region to the edge of the shaped charge liner;

an explosive charge in the housing behind the shaped charge liner; and a hood to close the opening at the front end of the projectile housing, the hood having a front portion with a center point which is disposed along the axis of the housing and having an attachment portion which is joined to the projectile housing a connection region and which has a cylindrical outer surface, the front portion of the hood having a wall with a thickness that decreases from the attachment portion to the center point and having an outer surface that is curved, the attachment portion of the hood having, at the connection region, a rearwardly oriented outer annular member which has an inner surface with a larger diameter than the projectile housing, a rearwardly oriented inner annular member which has an outer surface with a smaller diameter than the projectile housing, the outer surface of the inner annular member sloping at substantially the same angle as the wall region of the shaped charge liner with respect to the axis of the housing, and an annular recess between the inner and outer members, the annular recess receiving the front end of the housing and the edge of the shaped charge liner and providing a support for the explosive charge and the shaped charge liner when the hood hits a target.

11. The shaped charge projectile of claim 10, further comprising a detonator in the projectile housing.

12. The shaped charge projectile of claim 10, wherein the projectile housing has a wall and wherein the attachment portion of the hood has a wall with a thickness of about three times the wall thickness of the projectile housing.

13. The shaped charge projectile of claim 10, wherein the hood comprises a shell element and an annular element inserted into the shell element, the annular element providing the inner annular member.

14. The shaped charge projectile of claim 13, wherein the shell element is composed of an aluminum alloy having a tensile strength of at least 28 $kp/mm^2$ and wherein the annular element is composed of an aluminum alloy having a tensile strength of at least 52 $kp/mm^2$.

15. The shaped charge projectile of claim 10, wherein the front portion of the hood has a wall thickness that changes in steps.

16. The shaped charge projectile of claim 10, wherein the front portion of the hood has an inner surface with a conical central region which is hollowed out by turning.

17. The shaped charge projectile of claim 10, wherein the projectile housing has an annular groove adjacent the opening at the front end, and wherein the outer annular member of the attachment portion is bent into the groove to join the attachment portion to the projectile housing.

18. The shaped charge projectile of claim 10, wherein the outer surface of the front portion of the hood is hemispherical and merges into the cylindrical outer surface of the attachment portion of the hood.

* * * * *